US005715715A

United States Patent [19]

Nunez

[11] Patent Number: 5,715,715

[45] Date of Patent: Feb. 10, 1998

[54] LOCK ASSEMBLY WITH MOTORIZED POWER SCREW

[75] Inventor: Paul Nunez, Fairfield, Conn.

[73] Assignee: Sargent Manufacturing Company, New Haven, Conn.

[21] Appl. No.: 600,682

[22] Filed: Feb. 13, 1996

[51] Int. Cl.[6] ..... E05B 47/06

[52] U.S. Cl. ..... 70/283; 70/275; 70/280; 292/144

[58] Field of Search ..... 292/144, 142; 70/275, 277, 278, 280, 282, 283

[56] References Cited

U.S. PATENT DOCUMENTS

| | | | |
|---|---|---|---|
| 2,785,916 | 3/1957 | Mutti | 292/144 |
| 3,159,993 | 12/1964 | Crepinsek . | |
| 3,898,822 | 8/1975 | Schalm . | |
| 3,948,066 | 4/1976 | Solovieff . | |
| 4,286,812 | 9/1981 | Sprekeler . | |
| 4,536,020 | 8/1985 | Thomson . | |
| 4,583,382 | 4/1986 | Hull . | |
| 4,633,687 | 1/1987 | Fane | 70/413 |
| 4,695,082 | 9/1987 | Marks . | |
| 4,696,174 | 9/1987 | Marks . | |
| 4,926,664 | 5/1990 | Gartner et al. | 70/278 |
| 5,002,322 | 3/1991 | Fukumoto | 292/201 |
| 5,018,375 | 5/1991 | Tully . | |
| 5,020,345 | 6/1991 | Gartner et al. | 70/278 |
| 5,027,629 | 7/1991 | Liu | 70/280 |
| 5,083,122 | 1/1992 | Clark . | |
| 5,421,178 | 6/1995 | Hamel et al. . | |
| 5,437,174 | 8/1995 | Aydin | 70/278 |
| 5,474,348 | 12/1995 | Palmer et al. . | |
| 5,542,274 | 8/1996 | Thordmark et al. | 70/283 |

FOREIGN PATENT DOCUMENTS

| | | | |
|---|---|---|---|
| 7284 | of 1899 | United Kingdom | 292/142 |

*Primary Examiner*—Darnell M. Boucher
*Attorney, Agent, or Firm*—DeLio & Peterson, LLC

[57] ABSTRACT

A lock assembly comprising a casing, a lever rotatably attached to the casing, the lever having a spindle attached thereto, a motor secured to the casing, the motor having a shaft, a substantially cylindrical member attached to the motor shaft and having a helically extending groove, and an interfering member threadedly and non-rotatably engaged with the helically extending groove of the cylindrical member. The interfering member moves between a locked position and an unlocked position. The interfering member moves into the locked position to prevent rotation of the lever when the motor shaft rotates in one direction. The interfering member moves into the unlocked position to allow rotation of the lever when the motor shaft rotates in an opposite direction.

17 Claims, 4 Drawing Sheets

LOCK ASSEMBLY WITH MOTORIZED POWER SCREW

BACKGROUND OF THE INVENTION

1. Field of the Invention

The present invention is related to a lock assembly that utilizes a motorized lock actuator.

2. Problem to be Solved

Conventional lock assemblies that utilize motorized lock actuators typically include beveled gears, rack and pinions, or clutches. However such actuators may be bulky, unreliable and expensive. Still, other conventional lock assemblies utilize solenoids. However, a disadvantage of such assemblies is that the solenoid may be affected by a sudden impact. For example, upon sudden impact, the solenoid may temporarily retract and unlock the door. Thus, lock assemblies using solenoids may not be secure.

Conventional lock assemblies that utilize motorized lock actuators typically employ plungers or similar devices drivingly connected between a motor and other components of the lock assembly that effect locking and unlocking of the lock assembly. However, such a configuration may result in forces being exerted on the motor shaft thereby either dislodging the motor from its mount or damaging the motor. Furthermore, conventional lock assemblies that utilize motorized lock actuators are typically configured in a spring-loaded configuration. However, such a configuration is complicated in design and causes difficulty during assembly of the lock assembly. Additionally, conventional lock assemblies that utilize motorized lock actuators typically have no means of sensing when the lock assembly is in the locked or unlocked position. Thus, if the motor is initially energized to configure the lock assembly in the locked position and the lock assembly components fail to function in a manner to effect the locked position, the user of the lock assembly might not be aware that the lock assembly is not configured in the locked position.

It is therefore an object of the present invention to provide a new and improved lock assembly that utilizes a motorized lock actuator and which is simple in design and uses a minimum number of components.

It is another object of the present invention to provide a new and improved lock assembly that utilizes a motorized lock actuator which is reliable.

It is a further object of the present invention to provide a new and improved lock assembly that utilizes a motorized lock actuator which is space efficient.

It is another object of the present invention to provide a new and improved lock assembly that utilizes a motorized lock actuator and which is inexpensive to manufacture.

It is a further object of the present invention to provide a new and improved lock assembly that utilizes a motorized lock actuator wherein the motor is substantially isolated from forces caused by rotation of a lever of the lock assembly.

It is another object of the present invention to provide a new and improved lock assembly that utilizes a motorized lock assembly which does not require the use of spring-loaded devices.

It is yet another object of the present invention to provide a new and improved lock assembly that utilizes a motorized lock actuator wherein the motor is automatically and constantly re-energized until the lock assembly is configured in the locked position.

Still other objects and advantages of the invention will in part be obvious and will in part be apparent from the specification.

SUMMARY OF THE INVENTION

The above and other objects and advantages, which will be apparent to those skilled in the art, are achieved in the present invention which is directed to, in a first aspect, a lock assembly comprising a casing, a lever rotatably attached to the casing wherein the lever has a spindle attached thereto, a motor secured to the casing wherein the motor has a shaft, a substantially cylindrical member attached to the motor shaft and having a helically extending groove, and an interfering member threadedly and non-rotatably engaged with the helically extending groove of the cylindrical member. The interfering member moves between a locked position and an unlocked position. The interfering member moves into the locked position to prevent rotation of the lever when the motor shaft rotates in one direction. The interfering member moves into the unlocked position to allow rotation of the lever when the motor shaft rotates in an opposite direction.

The substantially cylindrical member comprises a core having an outer surface. The helically extending groove comprises a helically extending wall extending from the core outer surface. The helically extending wall comprises a pair of opposed substantially flat wall sections. The opposed wall sections are preferably vertical or nearly vertical having a sufficiently steep angle to the rotational axis of power screw to ensure that tabs of the interfering member, when engaged in the helically extending groove, cannot ride up the wall sections and jam the operation of the interfering member. The substantially cylindrical member further comprises a pair of stops. Each stop is positioned at a respective end of the cylindrical member for setting a maximum distance the interfering member can move. Each stop comprises a substantially flat wall radially extending from the core and transverse to the helically extending groove. Since the wall of each stop is vertical or radial to the rotational axis of the substantially cylindrical member, the tabs of the interfering member cannot ride up the walls and become dislodged from the groove when the tabs contact the walls of the stop. Thus, the opposed vertical wall sections of the helically extending wall and the vertical walls of each stop cooperate to effect complete stoppage of the interfering member without jamming the operation of the interfering member or dislodging the interfering member from the helically extending groove.

In a related aspect, the present invention is directed to a lock assembly comprising:

a) a casing;

b) a lever rotatably attached to the casing, the lever having a spindle attached thereto;

c) a motor secured to the casing, the motor having a shaft;

d) a substantially cylindrical member attached to the motor shaft and having a helically extending groove and a core having an outer surface, the helically extending groove comprising a helically extending wall extending from the core outer surface, the helically extending wall comprising a pair of opposed substantially flat wall sections, each wall section being angulated away from the other wall section and with respect to a reference line radial to the rotational axis of the substantially cylindrical member;

e) an interfering member threadedly and non-rotatably engaged with the groove of the cylindrical member, the interfering member moving between a locked position and an unlocked position, the interfering member moving into the locked position to prevent rotation of the lever when the motor shaft rotates in one direction, the interfering member moving into the unlocked position to allow rotation of the lever when the motor shaft rotates in an opposite direction; the wall sections of the helically extending wall being sufficiently angulated to prevent jamming of the interfering member; and f) a hub attached to the spindle for rotation therewith, the hub including a pair of radially extending teeth defining a notch, the interfering member being positioned within the notch when in the locked position to prevent rotation of the hub, the interfering member being positioned outside the notch when in the unlocked position to allow rotation of the hub.

BRIEF DESCRIPTION OF THE DRAWINGS

The features of the invention are believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENTS

In describing the preferred embodiment of the present invention, reference will be made herein to FIGS. 1–9 of the drawings in which like numerals refer to like features of the invention.

The lock assembly of the present invention may be referred to as an "exit device" wherein the interior handle is typically always unlocked but the exterior handle can be either locked or unlocked. Thus, the locking function of the exit device affects only the exterior handle.

Figure 1:
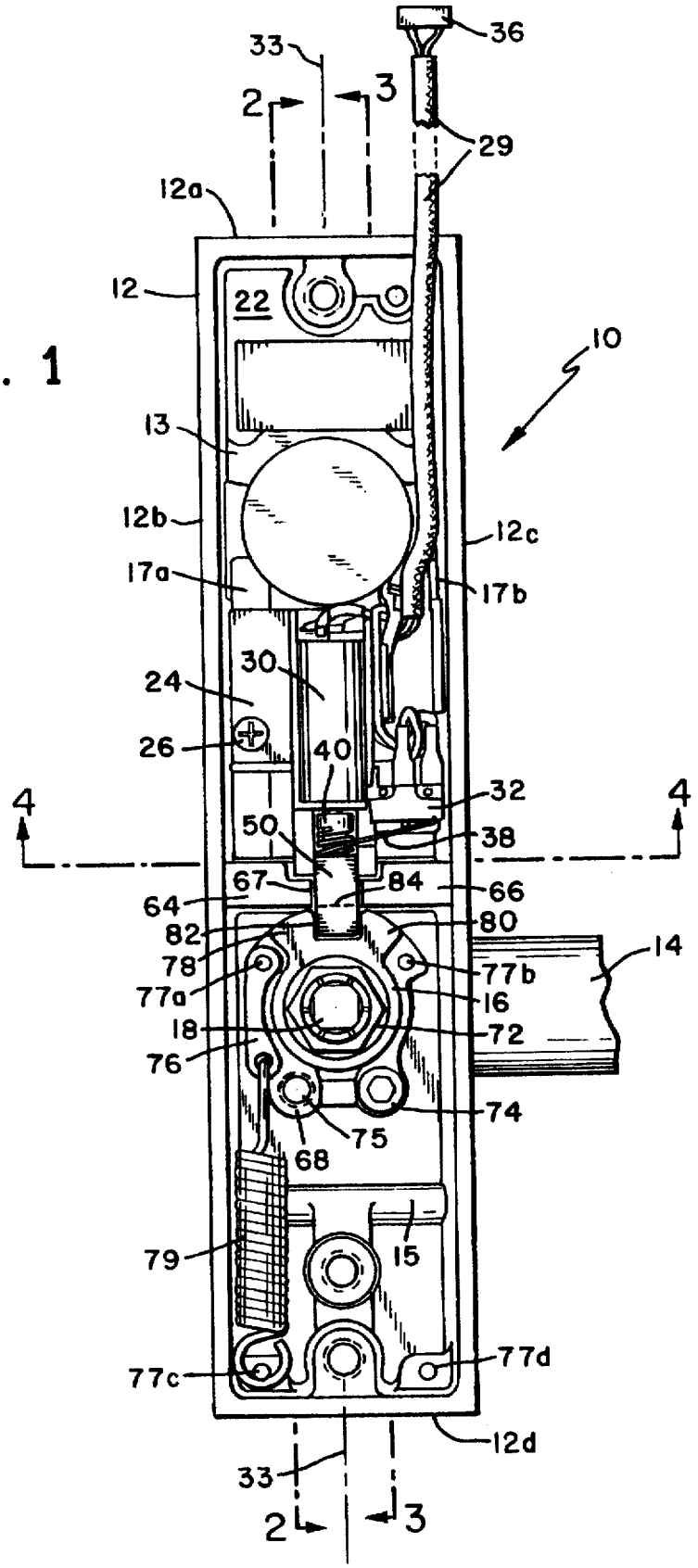
FIG. 1 is a plan view of the lock assembly of the present invention.
Figure 2:
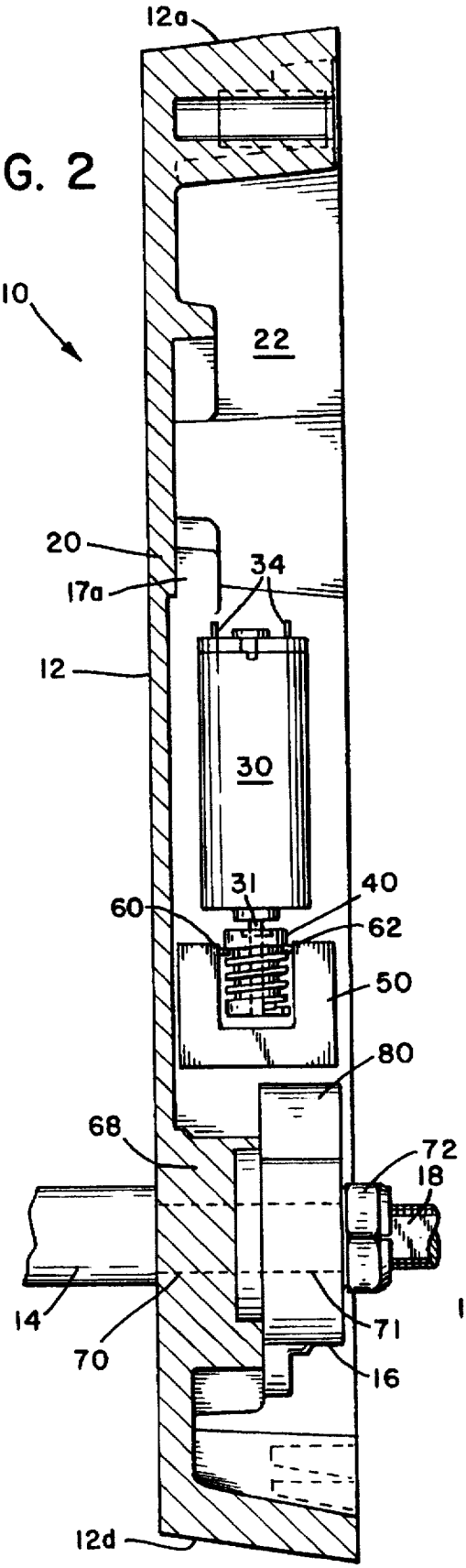
FIG. 2 is a view taken along line 2—2 in FIG. 1.
Figure 3:
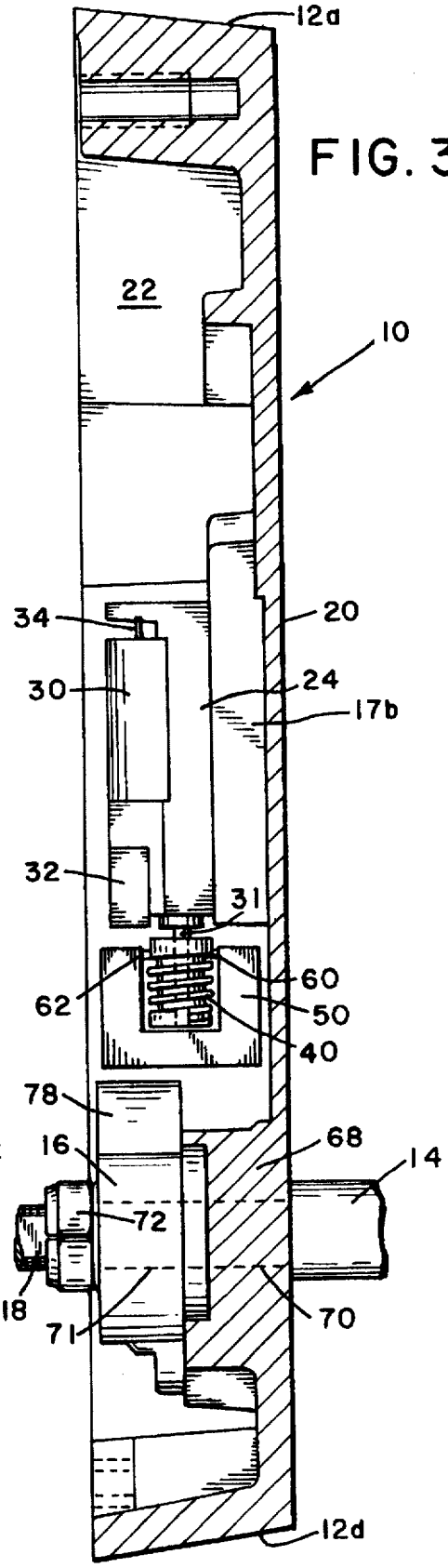
FIG. 3 is view taken along line 3—3 in FIG. 1.
Figure 4:
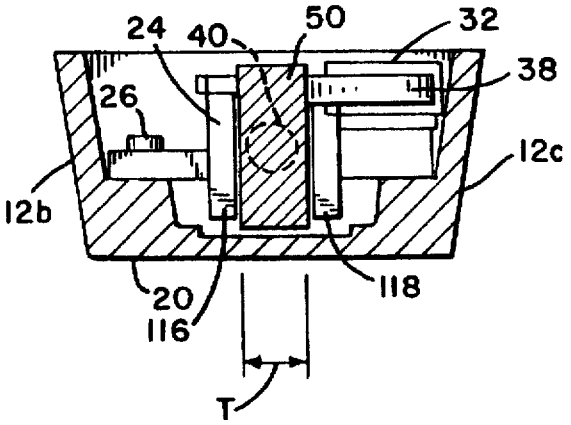
FIG. 4 is a view taken along line 4—4 in FIG. 1.
Figure 5:
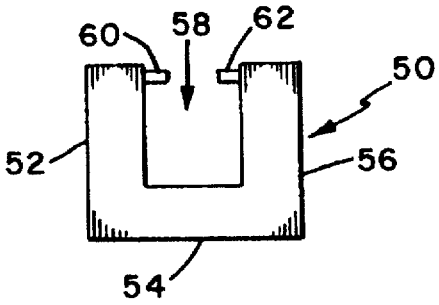
FIG. 5 is a side elevational view of a locking tail depicted in FIG. 1.

Referring to FIGS. 1–3, lock assembly 10 of the present invention generally comprises casing 12, lever or handle 14 (partially shown) and hub 16. Lever 14 is attached to spindle 18. Spindle 18 is engaged with other components (not shown) such as latch bolts, etc. Casing 12 comprises wall 12*a–d*, front side 20 and an open interior area 22 formed by side 20 and casing walls 12*a–d*. Ribs 13 and 15 are integral with casing 12 and thus provide structural support. Ribs 17*a* and 17*b* are also integral with casing 12. In a preferred embodiment, casing 12 is fabricated from a metallic material such as brass.

Figure 9:
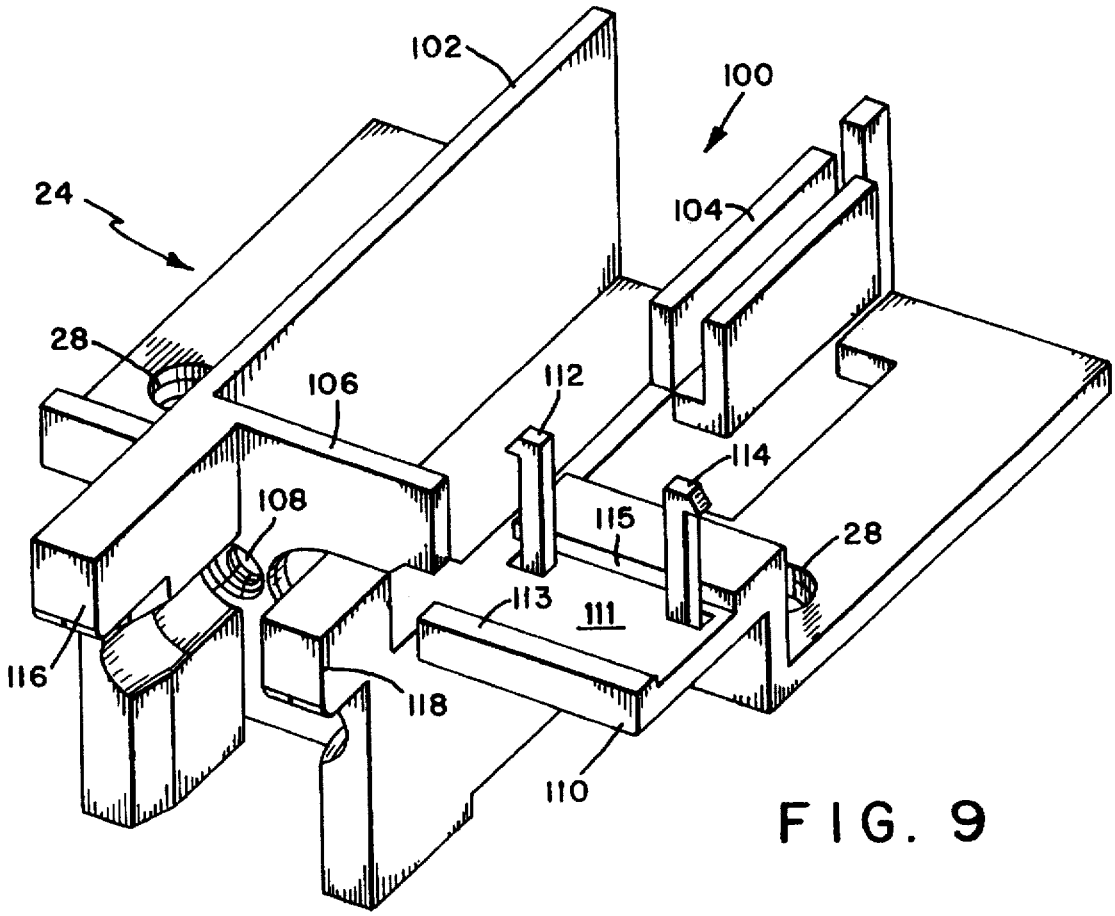
FIG. 9 is a perspective view of a motor mount depicted in FIG. 1.

Referring to FIGS. 1 and 9, motor bracket 24 is attached to ribs 17*a* and 17*b* via fasteners or screws 26 that are inserted through openings 28. Bracket 24 is preferably fabricated from an electrically non-conductive material. In a preferred embodiment, bracket 24 is fabricated from plastic. Motor 30 is positioned within area 100 defined by walls 102, 104 and 106. Motor 30 is attached to bracket 24 via fasteners or screws that are inserted through openings 108 in wall 106. Motor 30 includes shaft 31 (see FIG. 2) which extends substantially parallel to longitudinal axis 33 of casing 12. Preferably, motor 30 is a low power d.c. (direct current) motor.

Referring again to FIGS. 1 and 9, sensor-switch 32 is attached to mount 110 via protrusions 112, 114 that extend upward from mount 110 and are inserted into corresponding openings in sensor-switch 32. Sensor-switch 32 is positioned upon surface 111 between lips 113 and 115. Bracket 24 includes barriers 116 and 118 extending from wall 106. The purpose of barriers 116 and 118 will be discussed below.

Referring to FIGS. 1–3, power cable 29 is electrically coupled to motor contacts 34 and sensor-switch 32. Connector 36 is electrically coupled to cable 29 and couples a control system, controller or power source (not shown) to cable 29. Sensor-switch 32 includes contact arm 38 and a depressible actuator (not shown) that is controlled by the position of contact arm 38. This feature will be discussed below in detail.

Figure 6:
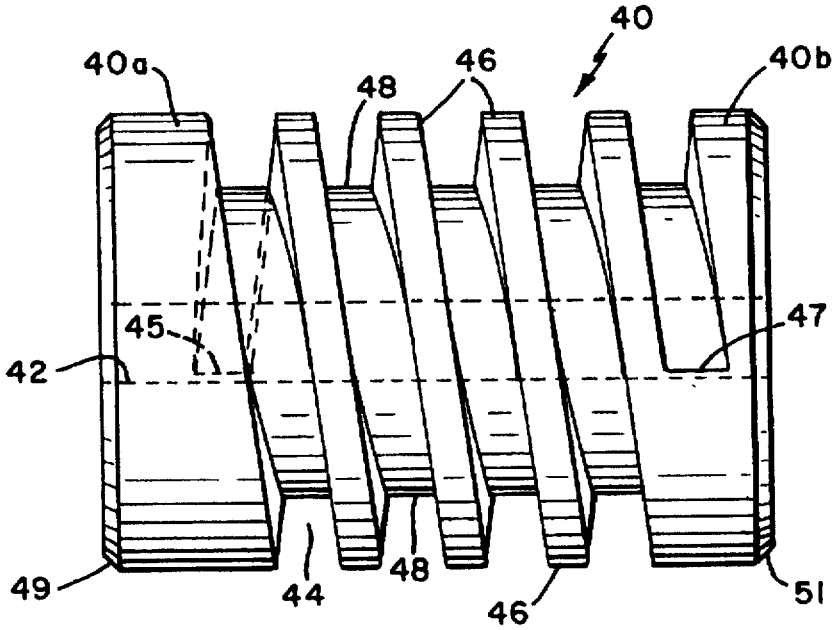
FIG. 6 is a side elevational view of a power screw depicted in FIG. 1.
Figure 7:
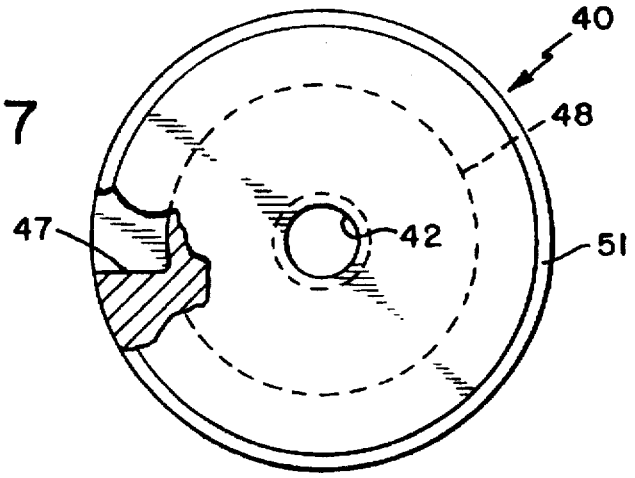
FIG. 7 is an end view of the power screw with a portion broken away to show a power screw stop.
Figure 8:
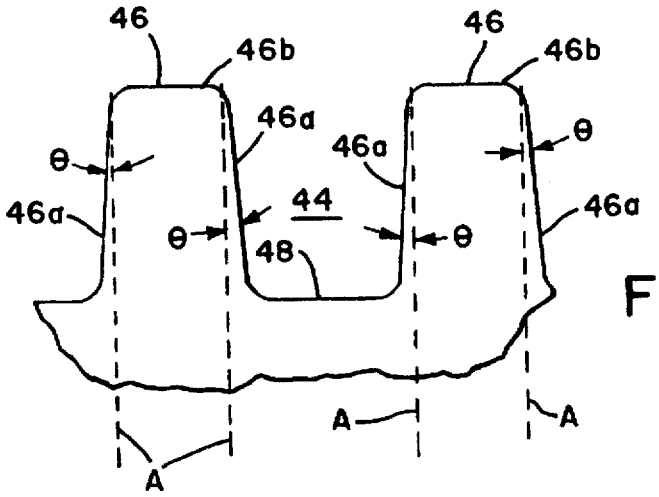
FIG. 8 illustrates the tooth profile of the power screw depicted in FIG. 6.

Referring to FIGS. 1–3, power screw 40 is coaxially attached to and rotates with shaft 31. In a preferred embodiment, power screw 40 is press fitted onto shaft 31. Referring to FIGS. 6–8, power screw 40 comprises a substantially cylindrical member that has bore 42 therethrough for receiving motor shaft 31 and a spirally or helically extending groove or gear track 44. Groove 44 is formed by teeth 46 and the outer surface of core 48. Teeth 46 radially extend from core 48. Referring to FIG. 8, each tooth 46 includes substantially flat and opposed wall sections 46*a* contiguous with top portion 46*b*. The opposed wall sections 46*a* are preferably vertical or nearly vertical having a sufficiently steep angle with respect to the rotational axis of power screw 40 to ensure that the projections 60 and 62, when engaged with groove 44 as discussed below, cannot ride up wall sections 46*a* and jam the operation of locking tail 50 (discussed below).

Opposed wall sections 46*a* are slightly angulated away from each other and with respect to dotted reference line A. Dotted reference lines A are radial to the rotational axis of power screw 40. In a most preferred embodiment, at any point along each wall section 46*a*, each wall section 46*a* is angulated at an angle $\Theta$ between about 0° and 10° with respect to reference line A. The purpose of this configuration of teeth 46 will be discussed below.

In a preferred embodiment, edges 49 and 51 of ends 40*a* and 40*b*, respectively, are chamfered. Power screw 40 is attached to shaft 31 such that end 40*a* is adjacent motor 30. Power screw 40 is fabricated from an electrically non-conductive material. In a preferred embodiment, power screw 40 is fabricated from plastic.

Referring to FIG. 6, groove 44 is bounded by substantially flat walls 45 (shown in phantom) and 47. Wall 45 is formed at the end of groove 44 that is adjacent end 40*a* of screw 40, radially extends from core 48 and is transverse to groove 44. Wall 47 is formed at the end of groove 44 that is adjacent end 40*b* of screw 40, radially extends from core 48 and is transverse to groove 44. The verticality of wall 45 ensures that projection 62 cannot ride up wall 45 when projection 62 contacts wall 45. Similarly, the verticality of wall 47 ensures that projection 60 cannot ride up wall 47 when projection 60 contacts wall 47. Thus, the radial or vertical walls 45 and 47 cooperate with the nearly vertical wall sections 46*a* to provide substantially square-shaped stops. The substantially square shape of each stop effects complete stoppage of locking tail 50 (discussed below) when tabs 60 and 62 contact walls 47 and 45, respectively, without dislodging tabs 60 and 62 from groove 44 and without jamming tabs 60 and 62.

It is apparent that jamming or dislodgment of locking tail 50 would also result in jamming of low power motor 30.

Thus, it can be appreciated that the configurations of wall sections 46a and walls 45, 47 not only prevent jamming of locking tail 50, but also prevent jamming of low power motor 30.

Referring to FIGS. 1–5, locking tail or interfering member 50 is substantially U-shaped and comprises portions 52, 54 and 56. In a preferred embodiment, locking tail 50 is fabricated from metal such as stainless steel. Portions 52, 54 and 56 are configured to define notch or space 58. Tabs or projections 60 and 62 are oppositely positioned from one another, located within notch 58 and are attached to portions 52 and 56, respectively. Tabs 60 and 62 are engaged with groove 44 of power screw 40 and contact vertical wall sections 46a. Locking tail 50 is movably positioned between barriers 116 and 118 of mount 24 (see FIG. 9) which act as guides for locking tail 50. Barriers 116 and 118 substantially eliminate lateral movement (in a direction transverse to longitudinal axis 33 of casing 12) of locking tail 50 as it traverses across power screw 40. The verticality of wall sections 46a of teeth 46 prevent tabs or projections 60 and 62 from riding up wall sections 46a and becoming dislodged from groove 44. Thus, the verticality of wall sections 46a prevent jamming the operation of locking tail 50. Barriers 116, 118 cooperate with vertical wall sections 46a to effect smooth linear movement of locking tail 50 without movement in any other direction.

Referring to FIG. 1, inner walls 64 and 66 extend from casing walls 12b and 12c, respectively, and are separated by passage 67. Passage 67 has a width slightly larger than the thickness T (see FIG. 4) of locking tail 50 and thus permits locking tail 50 to move through passage 67. Inner walls 64 and 66 prevent rotation of locking tail 50 during rotation of motor shaft 31. Inner walls 64 and 66 also guide locking tail 50 as it moves. When locking tail 50 has traversed the maximum distance on power screw 40, a substantial portion of locking tail 50 is not positioned between barriers 116 and 118. Thus, locking tail 50 has a slight degree of lateral movement such that it can contact inner walls 64 and/or 66. Thus, substantially all forces exerted on locking tail 50 are translated to inner walls 64 and/or 66 and not to motor bracket 24 or motor 30.

Referring to FIGS. 1–3, base 68 is integrally formed in casing 12 and has an opening 70 for receiving spindle 18. Hub 16 is supported by base 68 and has an opening 71 coaxially aligned with opening 70 in base 68 for receiving spindle 18. Hub 16 is attached to spindle 18 via nut 72. Spindle 18 is attached to handle or lever 14 (partially shown). Thus, when handle or lever 14 is rotated, hub 16 and spindle 18 also rotate. Screw 74 (see FIG. 1) is threadedly engaged to a threaded inlet (not shown) formed in base 68 to prevent rotation of hub 16 beyond a predetermined angle. Member 76 is pivotally attached to post 77a which is fastened to hub 16. Spring 79 is attached between member 76 and post 77c. Member 76 and spring 79 cooperate to maintain a constant rotational force on hub 16 in order to return lever 14 to its initial or original position after it is actuated. Screw 74, member 76 and spring 79 cooperate to allow clockwise rotation of hub 16. If counter-clockwise rotation of hub 16 is desired, then screw 74 can be inserted into threaded inlet 75, member 76 can be attached to post 77b and spring 79 can be attached between member 76 and post 77d.

Referring to FIG. 1, hub 16 includes radially extending teeth 78 and 80 which define notch or space 82. Notch 82 is sized to receive locking tail 50. Locking tail 50 is normally positioned within notch 82. This is referred to as the "locking position". When locking tail 50 is positioned within notch 82, hub 16 is prevented from rotating thereby preventing spindle 18, and hence lever 14, from rotating. Thus, the door to which the exit device is attached would be locked from the exterior. When locking tail 50 is in the locked position, substantially all forces exerted thereon due to lever 14 are translated to inner walls 64 and 66 and not to power screw 40, motor bracket 24 or motor 30.

When locking tail 50 is not positioned within notch 82 (the "unlocked position"), hub 16 is free to rotate thus allowing spindle 18 and lever 14 to rotate. Dotted line 84 represents the position of the edge of locking tail 50 when locking tail 50 is in the unlocked position.

When it is desired to unlock the exit device, i.e. allowing lever 14 on the exterior side of the door to rotate, motor 30 is energized with a first predetermined d.c. voltage to cause rotation of power screw 40 in a first direction that effects retraction of locking tail 50 from notch 82 such that the end of locking tail 50 is located at dotted line 84. Power screw 40 continues to rotate until projection or tab 60 contacts wall 45 of power screw 40. When projection 60 contacts wall 45, locking tail 50 is completely retracted from notch 82 thereby allowing hub 16 to rotate so as to allow the exterior handle to be rotated to open the door from the exterior side of the door.

When it is desired to lock or relock the exit device, motor 30 is energized with a second predetermined d.c. voltage to cause rotation of power screw 40 in a second direction that effects insertion or placement of locking tail 50 into notch 82 (the "locking position"). Power screw 40 continues to rotate until projection 62 contacts wall 47. When projection 62 contacts wall 47, locking tail 50 is completely inserted into or positioned within notch 82 thereby preventing hub 16 (and spindle 18) from rotating.

The first rotational direction is opposite the second rotational direction. Rotation in the first and second directions is achieved by changing the polarity of the d.c. voltage. Thus, when the power screw 40 rotates in the first direction, the d.c. voltage applied to the motor 30 has a first polarity and when the power screw 40 rotates in the second direction, the d.c. voltage applied to motor 30 has a second polarity opposite that of the first polarity.

As described above, sensor-switch 32 includes contact arm 38. Contact arm 38 is resilient and in a preferred embodiment, is fabricated from spring metal. As locking tail 50 is retracted from notch 82, locking tail 50 contacts contact arm 38 and forces or pushes contact arm 38 toward motor 30. When locking tail 50 moves a predetermined distance toward motor 30, contact arm 38 depresses the actuator of sensor switch 32. If it is desired to lock the exit device from the exterior, electrical power is transmitted through cable 29 to energize motor 30 to effect rotation of power screw 40 in the first direction in order to position locking tail 50 within notch 82. If locking tail 50 cannot return to the "locking position" and remains stationary, contact arm 38 maintains the actuator of sensor-switch 32 in a depressed state. If the control system (not shown) detects the actuation of the actuator of sensor-switch 32 when it is desired to position locking tail 50 in its locking position, the control system re-energizes or pulses motor 30 until locking tail 50 is moved into notch 82. Thus, sensor-switch 32 and contact arm 38 monitor the "unlocked position" of locking tail 50 thereby ensuring that motor 30 is re-energized if: (i) locking tail 50 becomes jammed, or (ii) lever 14 is rotated thereby preventing locking tail 50 from entering notch 82.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A lock assembly comprising:

a casing;

a lever rotatably attached to the casing, the lever having a spindle attached thereto;

a motor secured to the casing, the motor having a shaft;

a substantially cylindrical member directly attached to the motor shaft for rotation by the motor and having a helically extending groove with opposed wall sections; and an interfering member threadedly and non-rotatably engaged with the helically extending groove of the cylindrical member, the interfering member moving between a locked position in which the interfering member engages and prevents rotation of the spindle and an unlocked position in which the interfering member is disengaged from the spindle;

the interfering member directly engaging the helically extending groove in the cylindrical member and being directly and positively driven into the locked position by the cylindrical member to prevent rotation of the lever when the motor shaft rotates in one direction and the interfering member being directly and positively driven into the unlocked position by the cylindrical member to allow rotation of the lever when the motor shaft rotates in an opposite direction;

the opposed wall sections of the helically extending groove being sufficiently steep to prevent jamming of the interfering member.

2. The lock assembly of claim 1 wherein the wall sections are angulated away from each other and the degree of angulation of the wall sections is between about 0° and 10°.

3. The lock assembly of claim 1 wherein the substantially cylindrical member further comprises a pair of stops, each of which being positioned at a respective end of the substantially cylindrical member for setting a maximum distance the interfering member can move.

4. The lock assembly of claim 3 wherein each stop comprises a substantially flat wall extending radially relative to the substantially cylindrical member and transversely relative to the helically extending groove.

5. The lock assembly of claim 4 wherein the stops have a substantially square shape.

6. The lock assembly of claim 1 wherein the movement of the interfering member between the locked and unlocked position is substantially linear.

7. The lock assembly of claim 1 wherein the interfering member comprises a substantially U-shaped body portion including opposed sides and a closed end connecting the sides.

8. The lock assembly of claim 7 wherein the opposed sides and closed end define a space sized for receiving the substantially cylindrical member.

9. The lock assembly of claim 8 wherein the sides of the interfering member are provided at their free ends with inwardly extending projections for engagement with the helically extending groove on opposite sides of the substantially cylindrical member.

10. The lock assembly of claim 1 further comprising a hub attached to the spindle for rotation therewith, the hub including a pair of radially extending teeth defining a notch, the interfering member being positioned within the notch when in the locked position to prevent rotation of the hub, the interfering member being positioned outside the notch when in the unlocked position to allow rotation of the hub.

11. The lock assembly of claim 1 further comprising a sensor for sensing the position of the interfering member, the sensor outputting a signal indicating the position of the interfering member.

12. The lock assembly of claim 1 wherein the motor is electrically isolated from the casing.

13. The lock assembly of claim 12 further comprising a bracket attached to the casing for supporting the motor, the bracket being fabricated from an electrically non-conductive material.

14. The lock assembly of claim 13 wherein the bracket further comprises a pair of opposed barriers extending from the bracket and parallel to the axis of the substantially cylindrical member, the barriers define a space therebetween, the interfering member being movably positioned between the barriers.

15. The lock assembly of claim 1 wherein the casing includes a sidewall and a pair of inner walls extending from the sidewall and separated by a passage, the interfering member being moveable within the passage.

16. The lock assembly of claim 14 wherein the passage is sized such that when the interfering member is in the locked position, substantially all forces exerted on the interfering member due to the lever are translated to the pair of inner walls.

17. A lock assembly comprising:

a casing;

a lever rotatably attached to the casing, the lever having a spindle attached thereto;

a motor secured to the casing, the motor having a shaft;

a substantially cylindrical member directly attached to the motor shaft for rotation by the motor and having a helically extending groove and a core having an outer surface, the helically extending groove comprising a helically extending wall extending from the core outer surface, the helically extending wall comprising a pair of opposed substantially flat sides, each side being angulated away from the other side, each side, at any point thereof, is angulated with respect to a reference line radial to the rotational axis of the substantially cylindrical member;

an interfering member threadedly and non-rotatably engaged with the helically extending groove of the cylindrical member, the interfering member directly engaging the helically extending groove in the cylindrical member and being directly and positively driven between a locked position and an unlocked position by the cylindrical member, the interfering member moving into the locked position to prevent rotation of the lever when the motor shaft rotates in one direction and the interfering member moving into the unlocked position to allow rotation of the lever when the motor shaft rotates in an opposite direction, the sides of the helically extending wall being sufficiently angulated to prevent jamming of the interfering member; and a hub attached to the spindle for rotation therewith, the hub including a pair of radially extending teeth defining a notch, the interfering member being positioned within the notch when in the locked position to prevent rotation of the hub, the interfering member being positioned outside the notch when in the unlocked position to allow rotation of the hub.

* * * * *